US007624865B2

(12) United States Patent
Pendergraph et al.

(10) Patent No.: US 7,624,865 B2
(45) Date of Patent: Dec. 1, 2009

(54) SPECIALTY PRODUCT HANG TAG

(75) Inventors: Melvin A. Pendergraph, Arlington Heights, IL (US); Crystal Gray, Lansing, IL (US); Christopher R. Jahntz, Bartlett, IL (US)

(73) Assignee: Robert Bosch GmbH, Stuttgart (DE)

( * ) Notice: Subject to any disclaimer, the term of this patent is extended or adjusted under 35 U.S.C. 154(b) by 652 days.

(21) Appl. No.: 11/075,093

(22) Filed: Mar. 8, 2005

(65) Prior Publication Data

US 2006/0201836 A1 Sep. 14, 2006

(51) Int. Cl.
*B65D 85/20* (2006.01)
*B65D 73/00* (2006.01)

(52) U.S. Cl. ..... 206/379; 206/349; 206/478; 206/806

(58) Field of Classification Search ..... 206/379, 206/382, 349, 443, 446, 495, 806, 377, 461, 206/378, 481, 478; 211/69, 70.6, 60.1
See application file for complete search history.

(56) References Cited

U.S. PATENT DOCUMENTS

| | | | | | |
|---|---|---|---|---|---|
| 3,144,343 | A | | 8/1964 | Fritsche | |
| 3,280,969 | A | * | 10/1966 | Evans et al. | 206/349 |
| 3,487,915 | A | | 1/1970 | Scott | |
| 3,703,234 | A | | 11/1972 | Howard | |
| 3,809,221 | A | | 5/1974 | Compere | |
| 4,019,632 | A | | 4/1977 | Greenlee | |
| 4,168,002 | A | | 9/1979 | Crosby | |
| 4,729,473 | A | * | 3/1988 | Kulzer et al. | 206/477 |
| D295,833 | S | | 5/1988 | Roth | |
| D308,485 | S | | 6/1990 | Yeske | |
| D327,844 | S | | 7/1992 | Wimbish et al. | |
| 5,297,672 | A | | 3/1994 | MacTavish | |
| D353,092 | S | | 12/1994 | Green | |
| 5,477,964 | A | | 12/1995 | Hart | |
| 5,586,657 | A | | 12/1996 | Ward et al. | |
| 5,626,226 | A | | 5/1997 | Gardiner et al. | |
| 5,896,991 | A | | 4/1999 | Hippely et al. | |
| D412,631 | S | | 8/1999 | Green | |
| 5,979,649 | A | | 11/1999 | Rosler | |
| 5,979,652 | A | * | 11/1999 | Rosler | 206/481 |
| 5,979,662 | A | | 11/1999 | Green | |
| 6,425,482 | B1 | * | 7/2002 | Chiang | 206/349 |
| 6,662,948 | B1 | * | 12/2003 | Velliquette | 206/488 |
| 7,175,151 | B2 | * | 2/2007 | Chang | 248/689 |
| 2002/0134699 | A1 | * | 9/2002 | Bradfield et al. | 206/495 |
| 2003/0062277 | A1 | * | 4/2003 | Chen | 206/349 |
| 2005/0252870 | A1 | * | 11/2005 | Roesler | 211/69 |

* cited by examiner

*Primary Examiner*—Jila M Mohandesi
*Assistant Examiner*—Steven A. Reynolds
(74) *Attorney, Agent, or Firm*—Greer, Burns & Crain, Ltd.

(57) ABSTRACT

Embodiments of the invention comprise a hang tag for a product having an end portion that includes at least one closed recess. The hang tag has a retaining portion which is configured to receive and retain a portion of the product in a manner that resists rotation as well as removal. The hang tag also comprises a main body that is configured to provide a label bearing surface and a configuration for hanging the hang tag on a display rod. The retaining portion also has an interior opening for receiving the product and at least one flexible prong that is located in the opening that is configured to deflect away from the product when it is inserted into the opening and engage the closed recess to prevent removal of the product.

5 Claims, 5 Drawing Sheets

SPECIALTY PRODUCT HANG TAG

BACKGROUND OF THE INVENTION

The present invention generally relates to product display packages.

There have been many types of display packages designed for presenting relatively small products that are sold at retail as well as other stores, where the products are conveniently placed on rods or hooks that extend from a wall or display case. These are commonly known as hang or clip tags which are designed to hold the product, provide a surface for an identifying label and have an upper end portion containing an aperture for placing the hang tag over an outwardly extending rod or hook. Such hang tags are commonly used to market many products such as drill bits, elongated tools and the like. While display packages have been used which completely enclose such products in a preferably transparent plastic package, they are also generally more expensive and comparatively larger, which decreases the number of products that can be displayed in a given space.

It is desirable to reduce the size of display packaging and to this end, relatively thin elongated clip or hang tags have been designed which have a mounting aperture at the upper end thereof for placement on a hook or rod, an area on which labels can be placed with the lower portion being adapted to receive and hold a product, such as a drill bit, screwdriver and other tools, for example.

One of the biggest problems that retailers have is shoplifting by customers who will simply walk out with the product. It is for this reason that security tags are often placed on the hang tags. If the security tag is openly visible, the customers may not attempt to walk out with the product or they may attempt to remove the security tag. With regard to drill bits, customers have been known to switch the hang tags and swap a higher priced bit with another hang tag having a lower price.

It is for these reasons that there is a continuing effort to design hang tags that are inexpensive and have features that are effective to minimize theft.

SUMMARY OF THE INVENTION

Embodiments of the present invention comprise a hang tag for an elongated product having an end portion that includes at least one closed recess. The hang tag has a retaining portion which is configured to receive and retain a portion of the product in a manner that resists rotation as well as removal. The hang tag also comprises a main body that is configured to provide a label bearing surface and a configuration for hanging the hang tag on a display rod. The retaining portion also has an interior opening for receiving the product and at least one flexible prong that is located in the opening that is configured to deflect away from the product when it is inserted into the opening and engage the closed recess to prevent removal of the product.

DESCRIPTION OF THE PREFERRED EMBODIMENTS

Figure 6:
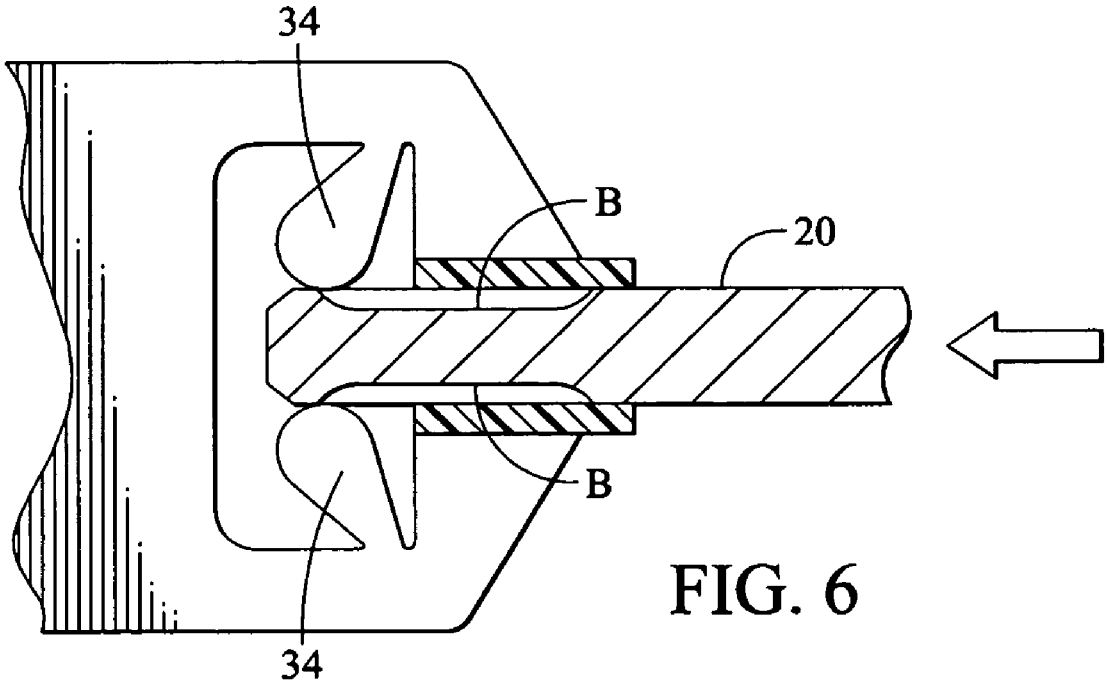
FIG. 6 is a diagrammatic plan view illustrating the operation of the preferred embodiment when a drill bit is inserted into the hang tag.
Figure 7:
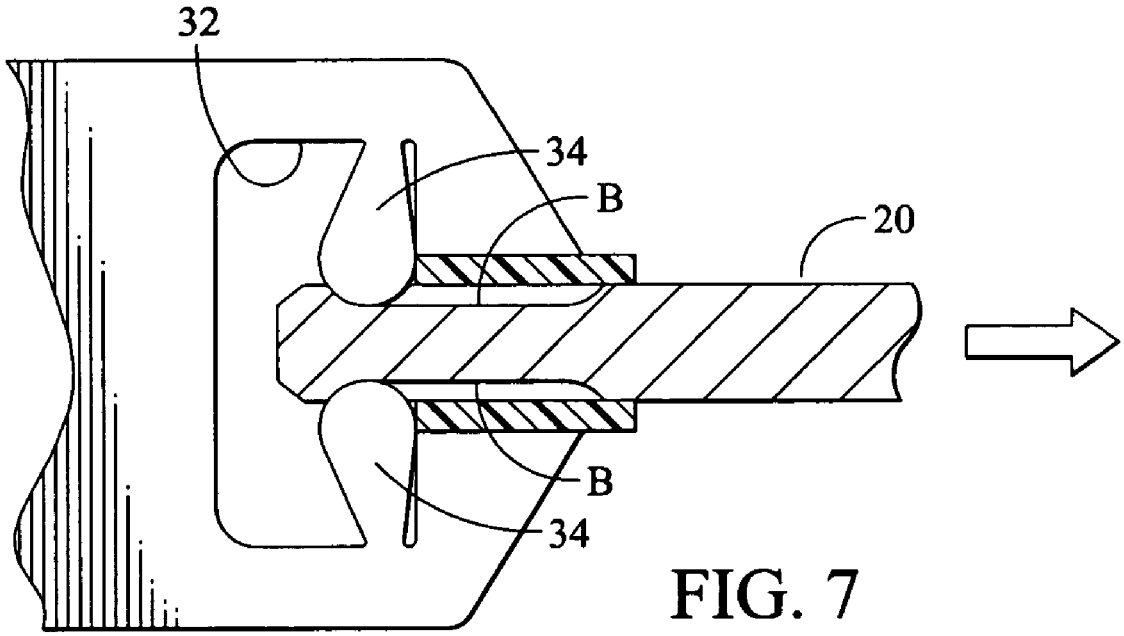
FIG. 7 is another diagrammatic illustration of the preferred embodiment after a drill bit has been inserted into the hang tag.
Figure 8:
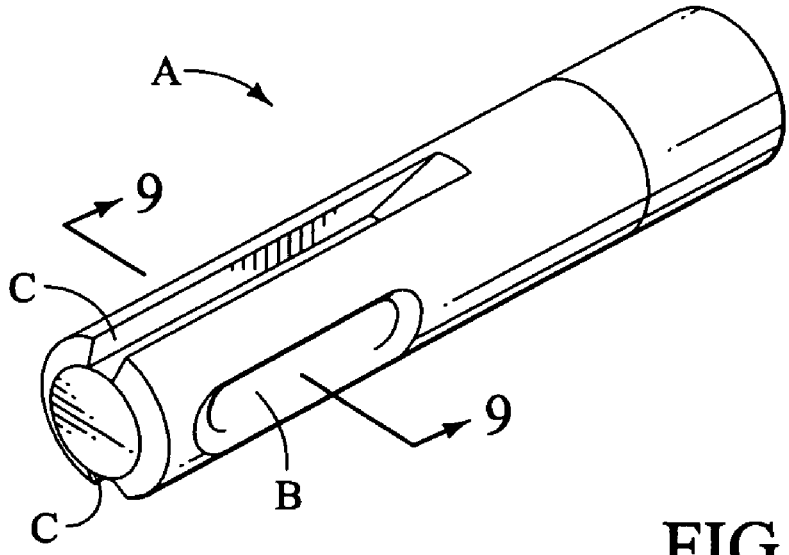
FIG. 8 is a perspective view of an SDS-plus shank portion.
Figure 9:
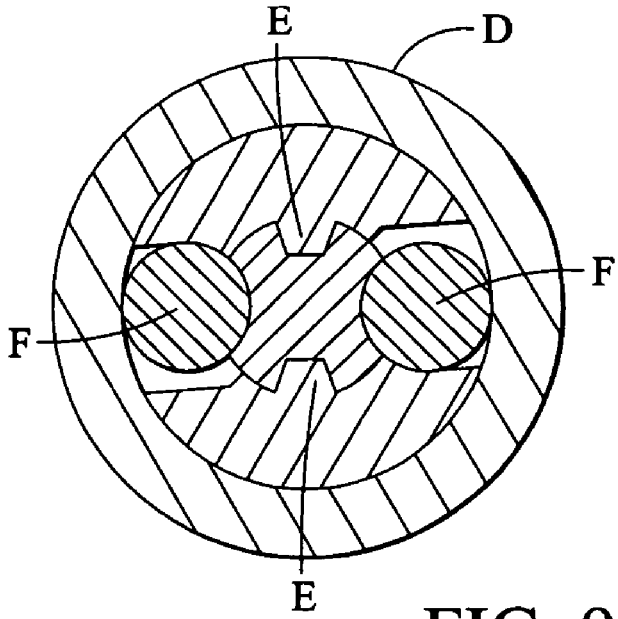
FIG. 9 is a cross section of a tool in which an SDS-plus shank has been inserted.

The preferred embodiment of the present invention is shown in FIGS. 1-7 herein and it is designed to hold and display a particular configuration of tools such as drill bits, with the particular configuration being known to those of ordinary skill in the art as an SDS-plus system that was developed by Robert Bosch GmbH in 1975 and has been used worldwide in drill hammer tools marketed by Bosch as well as other manufacturers. The SDS-plus system has the advantages of easily changing of drill bits and/or chisels, an automatic locking feature, the drill bit locking and torque transmission characteristics being separate from one another, and loss free torque transmission. As is shown in FIGS. 8 and 9, the SDS-plus system has a shank indicated generally at A that has a preferably 10 millimeter diameter and a pair of opposed closed axially oriented grooves B located on opposite sides of the shank. It also has a pair of axially oriented open grooves C that are oriented 90 degrees relative to the closed grooves B, which prevent rotation of the shank when inserted into a tool such as that shown at D in FIG. 9. The tool has a pair of driving ribs E that engage the open grooves C and also has a pair of locking balls F that engage the closed grooves B for safe tool retention.

While the preferred embodiment of the present invention is particularly designed to be used with the SDS-plus insertion system, it should be understood that other product configurations may be used with embodiments of the present invention provided that an insertable portion of the product is configured in some manner so that it can be prevented from being rotated and has an outer closed recess in which a prong-like member can engage to resist withdrawal of the product from the hang tag. In this regard, it should be understood that the insertable portion of the product may be non-cylindrical, such as oval shaped in cross section or rectangular, for example, or it may be cylindrical with grooves similar to the open grooves C shown in FIG. 8.

Figure 1:
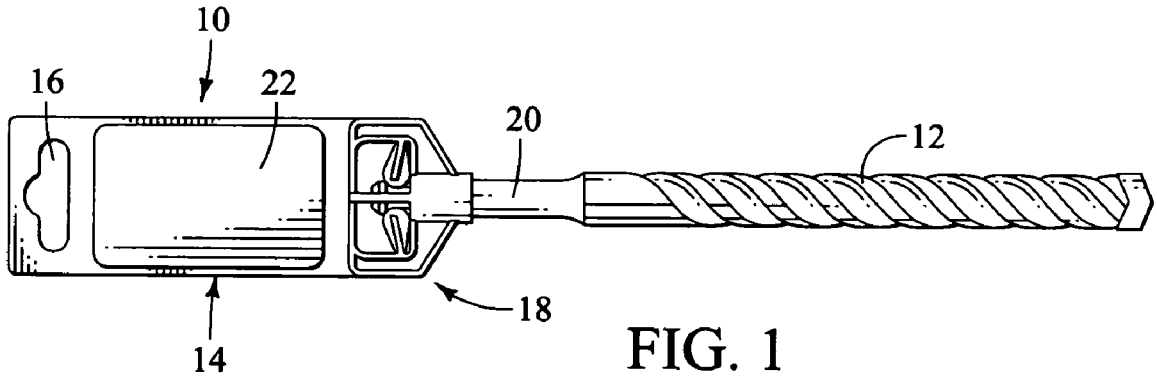
FIG. 1 is a plan view of the preferred embodiment of the present invention shown together with a drill bit inserted in the embodiment.

Turning now to the preferred embodiment illustrated in FIGS. 1-7, a hang tag, indicated generally at 10, is shown in FIG. 1 having a SDS-plus chisel drill bit 12 attached to it. The hang tag 10 has a main body portion 14, the top of which has a mounting aperture 16 and a bottom retaining portion 18 in which a shank 20 of the drill bit 12 is inserted. The main body portion 14 is shown to have a overlying label 22 on which indicia regarding the product being sold is located. While the label shown in FIG. 1 is rectangular and generally covers a major portion of one side of the body portion 14, the label may also be wrapped around the backside if desired to provide more information concerning the product and/or the manufacturer. The drill bit 12 shown in FIG. 1 is an SDS-plus tool having the shank configuration shown in FIGS. 8 and 9. The body portion 14 also preferably has a rectangular recess 24 which is configured to receive a security tag, such as a Sensormatic security tag that is generally known to those who are familiar with retail sales. An advantage of the use of the recess 24 for receiving the security tags is that the security tag is covered by the label 22 which not only prevents it from being easily removed, but tends to conceal the security tag from view.

Turning now to the receiving portion 18, it has a hollow cylindrical portion 26 having an inside surface 28 that is slightly larger than the outside diameter of the shank 20 of the drill bit so that the shank 20 can be inserted therein provided that it is properly angularly aligned. In this regard, the inside surface 28 of the cylindrical portion 26 contains a pair of interior axially aligned ribs 30 that have a complementary cross-section so that they fit within the open grooves C of the shank A shown in FIG. 8. The presence of these ribs not only angularly position the shank as it is inserted in the cylindrical portion 26 so that prongs of the tag are properly aligned with the closed grooves B, but also prevent the shank from being angularly rotated.

The retaining portion 18 also has an interior opening 32 that is generally in the form of a rectangle from which a pair of prongs, indicated generally at 34, extend from opposite sides of the opening toward one another at an angle that is inclined away from the cylindrical portion 26. The hang tag 10 is preferably made of a flexible plastic material that has at least limited flexibility so that the prongs 34 can flex within the interior opening 32. In this regard, the prongs have a base portion 36 and an enlarged rounded end portion 38. The size of the rounded portion 38 is preferably approximately the same diameter as the closed groove B shown in FIG. 8.

Figure 3:
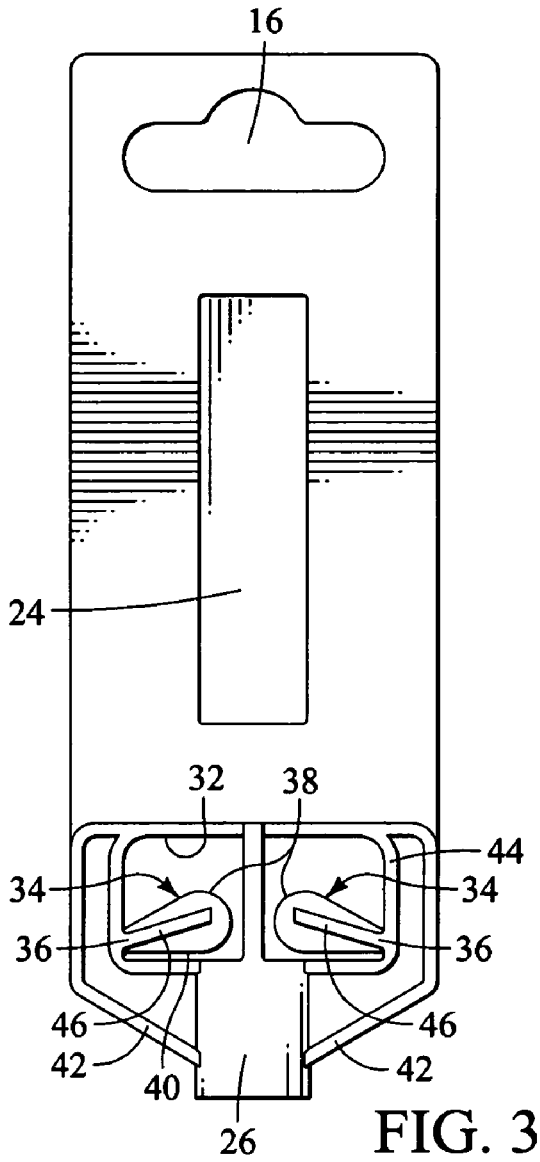
FIG. 3 is a plan view of the embodiment shown in FIG. 1.
Figure 4:
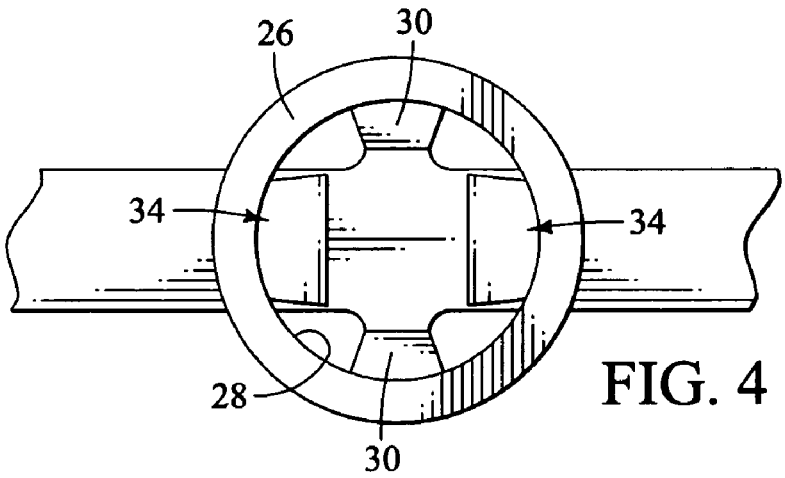
FIG. 4 is a bottom end view of the embodiment shown in FIG. 2.

As is shown in FIG. 4, the end 38 extends into an extended cylinder defined by the inside surface 28 of the cylindrical portion 26 so that when the shank 20 is inserted into the opening 28, the end of it will contact the prongs 34 to separate them from one another until the end of the shank passes and the prongs 34 engage the closed groove B. This is shown in FIGS. 6 and 7 where the shank pushes the prongs apart until the prongs are free to enter the closed grooves B. After they have engaged the grooves, the shank cannot thereafter be withdrawn from the tag because of the prongs engagement with the end of the closed groove B. As is best shown in FIGS. 3 and 7, there is a small gap 40 between the prongs 34 and the adjoining surface of the interior opening 32 so that when a force is applied to the shank 20 to remove it from the tag as shown in FIG. 7, the prong will be brought into contact with the wall of the opening 32.

Figure 2:
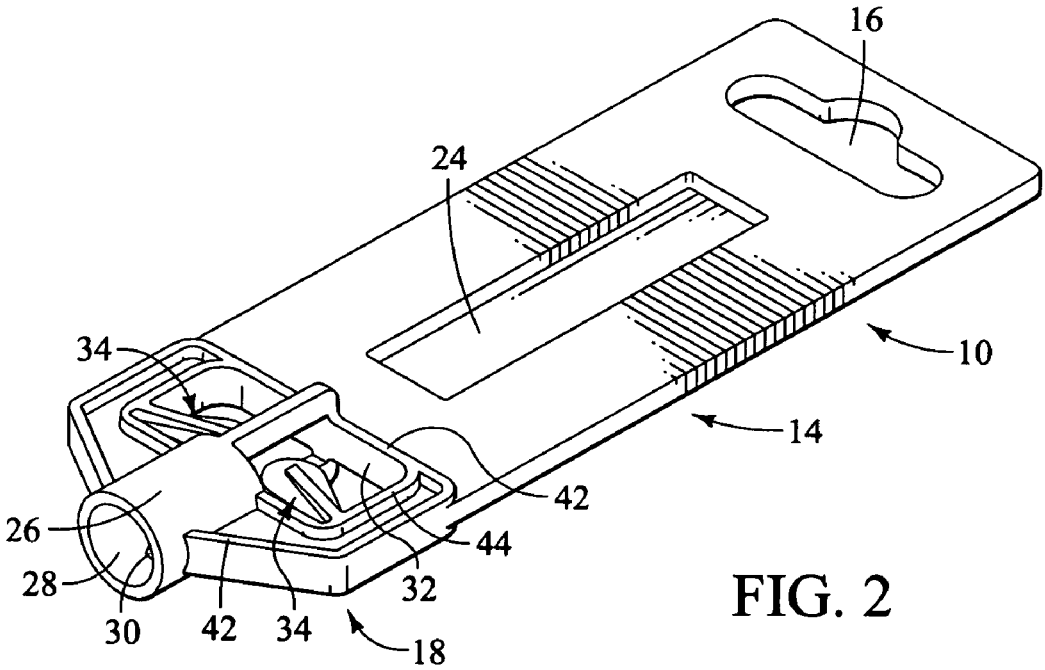
FIG. 2 is a perspective view of the preferred embodiment shown in FIG. 1.
Figure 5:
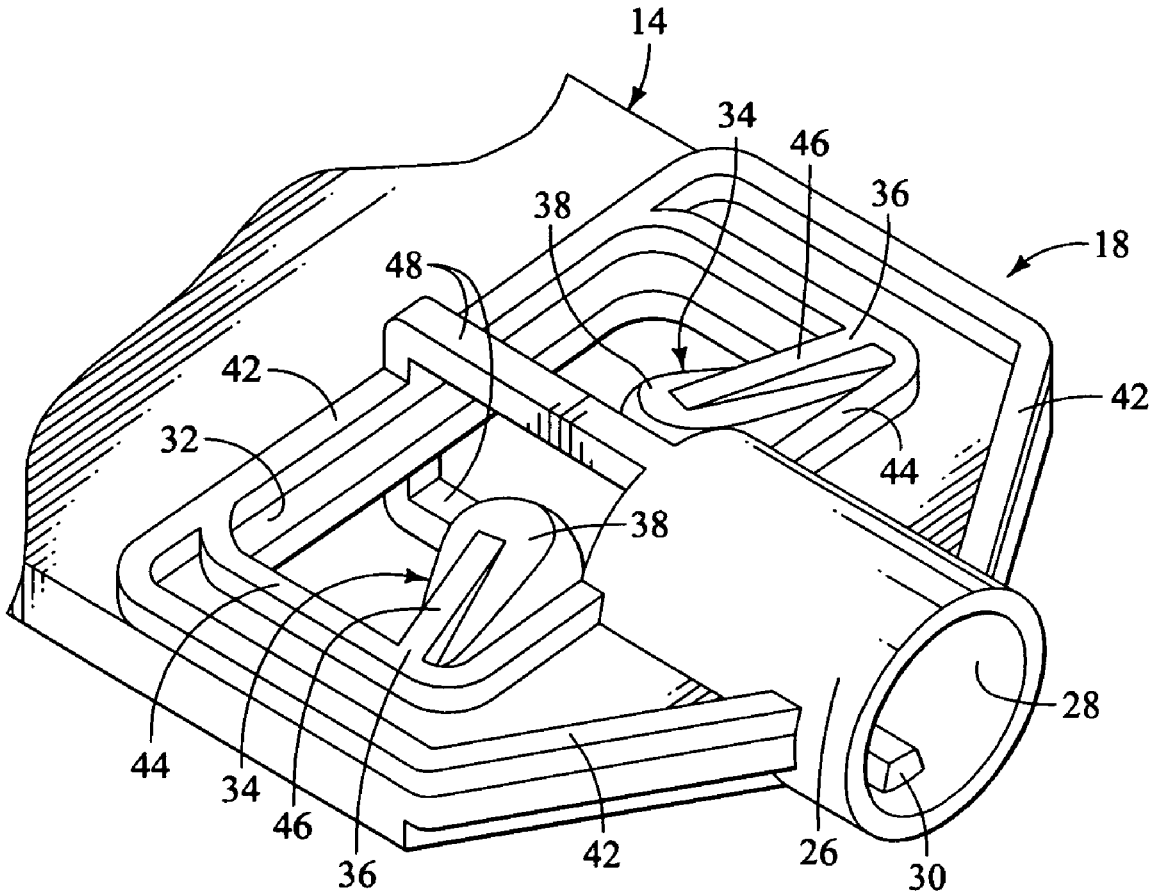
FIG. 5 is a cross-section taken generally through the line 5-5 of FIG. 3.

As is best shown in FIGS. 2 and 5, the retaining portion 18 has thicker perimeter walls around the entire outside of it as shown at 42 and around the interior opening 32 as shown at 44 to increase the strength of the perimeter of the interior opening. The thicker wall 44 extends to and also form a transition portion 46 of each prong which increases the compressive strength of the prong if a large force is applied attempting to remove the drill bit from the hang tag. However, to facilitate insertion of the drill bit into the hang tag, it is thin in the direction that the prong must deflect when the shank is inserted into the interior opening 32. The increased thickness of the transition portion near the portion 36 provides increased strength that resists removing of the shank from the hang tag 10. Upper and lower bridge portions 48 also extend from the cylindrical portion 26 to the far end of the interior opening 32 and provide structural rigidity to the hang tag 10.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A hang tag for a product having a relatively small first end portion with a generally circular cross section with open axial oriented grooves on opposite sides thereof and closed axially oriented grooves on opposite sides thereof, wherein the open and closed grooves are oriented at 90 degrees relative to one another, comprising:

a main body having a configuration at a top end portion for hanging said tag on a display and a retaining portion for receiving and holding the product and having a bottom end surface;

said retaining portion comprising:

a generally rectangularly shaped interior opening located between the bottom end surface and said main body;

a receiving portion having a receiving opening extending from said bottom end surface to said interior opening, said receiving opening being configured to receive the first end portion therein and having at least one interior rib in said receiving opening for engaging at least one of the open axial grooves to prevent rotation of the product and to place the product at a predetermined angular position; and at least one deflectable prong extending into said interior opening configured to deflect away from the end portion of the product when the product is inserted into said interior opening and engage the closed groove to prevent removal of the product;

each said at least one prong being elongated and having a transitional portion and a generally rounded end portion sized and configured to generally conform to the curved ends of the closed grooves and extending from the bottom portion into said interior opening at an acute angle relative to the lengthwise direction of said cylindrical opening, whereby a force applied to pull the bit from the cylindrical opening is transmitted generally along the length of said prongs;

wherein said transition portion has a relatively narrow dimension at the interface with said bottom portion to generally define a hinge enabling said at least one prong to deflect away from the shank when the shank is inserted in said cylindrical opening, said transition portion having a larger dimension in the direction transverse to said narrow dimension interface.

2. A hang tag as defined in claim 1 wherein said larger dimension in the direction transverse to said narrow dimension interface comprises a rib of material extending from opposite sides of said narrow dimension interface.

3. A hang tag for a SDS-Plus shank drill bit, comprising:

a main body configured to provide a label bearing surface, said body having a configuration for hanging said tag on a display;

a SDS-Plus shank retaining portion located at a bottom portion of said body, comprising:

a generally cylindrical opening in said bottom end for receiving the shank;

at least one interior rib for engaging one of the open longitudinal grooves, each said rib having a cross sectional area that substantially fills one of said open longitudinal grooves to prevent rotation of the shank in the opening and to position the shank at a predetermined angular position;

at least one interior opening in said bottom portion communicating with said cylindrical opening configured to receive the free end portion of the shank so that at least one of the closed grooves is located in said interior opening;

a first deflectable prong extending into said interior opening configured to deflect away from the end of the shank when it is inserted into the interior opening and engage one of the closed grooves to prevent removal of the drill bit;

a second elongated prong extending into said interior opening configured to deflect away from the end of the shank when it is inserted into the cylindrical opening and engage the other closed groove;

wherein each of said first and second prongs are elongated and extend from the bottom portion into said interior opening at an acute angle relative to the lengthwise direction of said cylindrical opening, whereby a force applied to pull the bit from the cylindrical opening is transmitted generally along the length of said prongs;

wherein said first and second elongated prongs have a transitional portion and a generally rounded end portion sized and configured to generally conform to the curved ends of the closed grooves;

wherein said transition portion has a relatively narrow dimension at the interface with said bottom portion to generally define a hinge enabling said prong to deflect away from the shank when the shank is inserted in said cylindrical opening, said transition portion having a larger dimension in the direction transverse to said narrow dimension interface.

4. A hang tag as defined in claim 3 wherein said larger dimension in the direction transverse to said narrow dimension interface comprises a rib of material extending from opposite sides of said narrow dimension interface.

5. A hang tag as defined in claim 4 wherein said hang tag comprises a unitary formed flexible plastic material.

* * * * *